United States Patent [19]

Nagashima et al.

[11] 4,273,684

[45] Jun. 16, 1981

[54] TRANSPARENT DETERGENT BAR

[75] Inventors: Tetsuya Nagashima, Ogose; Yasunori Usuba, Tokyo; Takahisa Ogawa, Kawagoe; Masahiro Takehara, Fujisawa, all of Japan

[73] Assignees: Ajinomoto Co., Inc.; Kawaken Fine Chemicals Co., Ltd., both of Tokyo, Japan

[21] Appl. No.: 152,176

[22] Filed: May 22, 1980

[30] Foreign Application Priority Data

May 3, 1979 [JP] Japan ..... 54-66788
Feb. 13, 1980 [JP] Japan ..... 55-15555

[51] Int. Cl.[3] ..... C11D 1/10; C11D 3/43; C11D 11/00; C11D 17/00

[52] U.S. Cl. ..... 252/544; 252/142; 252/143; 252/153; 252/174; 252/545; 252/546; 252/DIG. 16

[58] Field of Search ..... 260/404, 404.5; 252/134, 142, 143, 174, 544, 546, DIG. 16, 368, 370, 545, 153

[56] References Cited

U.S. PATENT DOCUMENTS

| | | | |
|---|---|---|---|
| 2,005,160 | 6/1935 | Pape | 252/134 |
| 2,675,356 | 4/1954 | Woodworth | 252/110 |
| 3,507,797 | 4/1970 | Mazumder | 252/544 X |
| 3,562,167 | 2/1971 | Kamen | 252/121 |
| 3,663,459 | 5/1972 | Yoshida | 252/546 |
| 3,926,828 | 12/1975 | O'Neill | 252/117 |
| 4,165,293 | 8/1979 | Gordon | 252/118 |

FOREIGN PATENT DOCUMENTS

| | | | |
|---|---|---|---|
| 48-10921 | 4/1973 | Japan | 252/174 |
| 50-92307 | 7/1975 | Japan | 252/174 |
| 51-24606 | 2/1976 | Japan . | |

*Primary Examiner*—Dennis L. Albrecht
*Attorney, Agent, or Firm*—Oblon, Fisher, Spivak, McClelland & Maier

[57] ABSTRACT

A transparent detergent bar possessing good foaming power and detergency in hard water is formulated consisting essentially of at least one salt of a N-long chain acyl-optically active acidic amino acid neutralized with a basic amino acid in the ratio of 1 mol of the former to 1 to 2 mols of the latter and water in the range of 5 to 35% based on the weight of the bar apart from water. Other adjuvents may be present.

10 Claims, No Drawings

TRANSPARENT DETERGENT BAR

BACKGROUND OF THE INVENTION

1. Field of the Invention

This invention relates to a transparent detergent bar and a method of making the same.

2. DESCRIPTION OF THE PRIOR ART

A conventional transparent detergent bar has been usually prepared by using soap of fatty acid as a base and saccharides such as glucose, fructose and sucrose and polyhydric alcohol such as glycerine, sorbitol, propylene glycol as an agent to impart transparency to the soap. Soap of fatty acid and the agent have been heat dissolved into a solvent of water-lower alcohol, poured into a frame, cooled and solidified according to the conventional framing method.

Though the transparent soap made by the conventional method has high commercial value and gives the consumers the feeling of high grade because of its transparency, the quality of the soap is substantially the same as the normal opaque fatty acid soap. The defects of the soap such as irritation to the skin because of a free alkali content and the rise of pH by hydrolysis, inferior foaming power in hard water and the formation of insoluble lime soap during use cannot be removed.

The synthetic detergent bars containing essentially of mono-salt of N-long chain acyl acidic amino acid are disclosed in U.S. Pat. No. 3,663,459. They have a mild and soft touch to the skin, good hardness and superior detergency and have not the above defects of the fatty acid soap. Their appearance, however, is opaque.

The attempt has been made to make the transparent fatty acid soap by adding monosodium salt of N-long chain acyl acidic amino acid to the base of fatty acid soap (cf. Japan KOKAI 76-24606). However transparent detergent bar of high grade consisting essentially of N-long chain acyl acidic amino acid salt has heretofore been not known.

It has been found that among the detergent bars consisting mainly of N-long chain acyl-optically active acidic amino acid basic amino acid salt, some bars containing a certain length of acyl derivatives, a certain kind of amino acids and having a certain neutralization degree are inferior to some degree in transparency. There is a tendency that said transparency is impaired when the bar is left standing in an atmosphere of high humidity.

It has not been known that the transparent detergent bar could be successfully prepared by using as the main component basic amino acid salt of N-long chain acyl optically active acidic amino acid or the mixture of said salt with urea.

SUMMARY OF THE INVENTION

Accordingly, one object of the invention is to provide a transparent detergent bar by using as the main component basic amino acid salt of N-long chain acyl optically active acidic amino acid or the mixture of said salt with urea.

Another object of the invention is to provide a transparent detergent bar which is weakly acidic or neutral, gives soft and smooth feeling to the skin but no skin irritation and has good foaming power and detergency even in hard water.

Another object of the invention is to provide a transparent detergent bar which is resistant to the reduction of transparency during storage in a humid place by using as the main component the mixture of urea with basic amino acid salt of N-long chain acyl optically active acidic amino acid.

A further object of the invention is to provide a method of making a transparent detergent bar not only by a framing method but also by a milling method.

DESCRIPTION OF THE PREFERRED EMBODIMENTS

The present invention relates to a transparent detergent bar, more particularly to a novel transparent detergent bar which is prepared by molding basic amino acid salt of N-long chain acyl-optically active acidic amino acid or the mixture of urea and basic amino acid salt of N-long chain acyl-optically active amino acid as a main component.

It has now been found that the transparent detergent bar can only be prepared by using basic amino acid salt of N-long chain acyl-optically active acidic amino acid as a base.

The transparent detergent bar of the invention is prepared by molding basic amino acid salt of N-long chain acyl-optically active acidic amino acid which is obtained by the reaction of 1 mol of N-long chain acyl-optically active acidic amino acid with 1 to 2 mols of basic amino acid.

Optically active acidic amino acid in the molecule of N-long chain acyl-optically active acidic amino acid is at least one member selected from the group consisting of D or L form of aspartic acid, glutamic acid, cysteic acid and homocysteic acid. When acidic amino acid is racemic form, the detergent bar thereof is inferior in transparency.

Basic amino acid used to neutralize N-long chain acyl-optically active acidic amino acid is one member selected from the group consisting of lysine, arginine and ornithine. These basic amino acids can be used as optically active and racemic form. The transparency decreases to some degree when racemic form of basic amino acid is used.

The neutralization degree of N-long chain acyl-optically active acidic amino acid with basic amino acid is 1.0 to 2.0 equivalent (1 mol of N-long chain acyl optically active acidic amino acid to 1 to 2 mols of basic amino acid). If the neutralization degree is below 1.0 equivalent, the detergent bar is inferior in transparency and foaming power, and if it is above 2.0 equivalent, the characteristics of the bar are not desirable because of inferior foaming power, undesirable hardness and occasional coloration with the lapse of time.

The long chain acyl group of N-long chain acyl-optically active acidic amino acid of the invention is that of saturated or unsaturated fatty acid having 10 to 20 carbon atoms. The detergent bars made of N-long chain acyl derivatives having saturated fatty acids of 10 to 16 carbon atoms and unsaturated fatty acid of 16 to 18 carbon atoms are excellent in transparency.

Polyhydric alcohol such as glycerine, diglycerine, ethyleneglycol, propyleneglycol, sorbitol and saccharides such as glucose, fructose and sucrose are used in preparing the conventional transparent soap to impart transparency to the soap. Perfumes and coloring matters are usually added to the above components.

The other anionic, amphoteric and nonionic surface active agents can be used to the extent that they do not inhibit transparency of the bar.

These surface active agents are fatty acid soap, salt of higher alcohol sulphuric acid ester, salt of polyoxyethylene higher alcohol sulphuric acid ester, higher alcohol phosphoric acid ester and its salt, polyoxyethylene higher alcohol phosphoric acid ester and its salt, polyoxyethylene higher fatty acid phosphoric acid ester and its salt, salt of sulphonated higher fatty acid alcohol ester, salt of sulphosuccinic acid higher alcohol ester, salt of isethionic acid higher fatty acid ester, salt of α-sulpho higher alcohol acetic acid ester, the condensation products of higher fatty acids with alkylolamine (such as lauric acid diethanol amide, stearic acid diethanol amide, lauric acid mono ethanol amide, stearic acid mono ethanol amide), the addition products of ethylene oxide to these condensation products, polyoxyethylene higher fatty acid mono ethanol amide phosphoric acid ester, N-long chain acyl acidic amino acid salt (salt of other than basic amino acid, such as alkali metal salt, ammonium salt, alkanol amine salt and the like), N-long chain acyl amino acid salts such as N-long chain acyl sarcosinate, N-long chain acyl-N-alkyl-β-alaninate, N-acyl peptide, higher alkyl amino propionate such as lauryl amino propionic acid and the like, higher alkyl imino diacetate such as lauryl imino diacetate and the like, betaine detergents such as higher alkyl dimethyl betaine, higher alkyl dihydroxy ethyl betaine, and amine amino compounds such as (N-alkyloyl-N'-(2-hydroxyethyl)-N'-carboxymethyl ethylene diamine-salt, N-alkyloyl-N-(2-hydroxyethyl)-N', N'-bis carboxy methyl ethylene diamine-salt and the like. The surface active agent is not limitted to the above mentioned ones.

We have discovered that the detergent bars being excellent in transparency and resistant to the reduction of transparency in a humid place can be obtained by molding the base in which urea is incorporated to the salt of N-long chain acyl acidic amino acid.

The ratio of the amount of N-long chain acyl-optically active acidic amino acid basic amino acid salt to that of urea is 95:5 to 50:50 by weight, preferably is 90:10 to 60:40 by weight.

If the amount of urea is below 5% by weight, it does not contribute to advance transparency of the bar, and if above 50% by weight, the foaming power of the bar is reduced and the bar becomes soft. Moreover the hygroscopic property of the bar is increased and crystallization occurs on the surface of the bar. Therefore the commercial value of the bar is reduced.

The transparent soap consisting mainly of fatty acid soap is prepared usually by a framing method. The soap of excelled transparency can be produced by the framing method. Opaque soap is produced by a milling method. Therefore only a small amount translucent soap is marketed. It is a great characteric of the present invention that the transparent bar can be produced not only by a framing method but also by a milling method.

The transparent detergent bar of the invention is prepared by a conventional framing method. N-long chain acyl-optically active acidic amino acid-basic amino acid salt with or without urea and the adjuvants are dissolved in a mixture of lower alcohol such as ethanol and water, and the resultant solution is poured into a frame, cooled, solidified, cut and dried. The mixing ratio of lower alcohol to water is preferably 1:0.5 to 1:3 by weight and the concentration of N-long chain acyl-optically active acidic amino acid-basic amino acid salt in said solution is preferably 40–75% by weight.

Heating at a temperature of 70°–85° C. is desirable to achieve complete and prompt dissolution of the solute. The drying period to obtain the transparent detergent bar of the invention by the framing method is required 30–60 days as is required for the conventional transparent soap.

To prepare the transparent detergent bar of the invention by a milling method, N-long chain acyl-optically active acidic amino acid-basic amino acid salt with or without urea and the adjuvants are mixed with water, and the resultant mixture is milled on a roller and/or pelletizer, extruded and pressed.

The amount of water to be added to the base mixture is 5–25% by weight when the neutralization degree of N-acyl derivatives is 1.0–1.5 equivalent and is 5–35% by weight when the neutralizaton degree is 1.6–2.0 equivalent.

The transparent detergent bar of the invention thus obtained has the following excellent properties and advantages:

1. Since pH during the use is weakly acidic or neutral, a person who cannot use the conventional soap because of its strong alkalinity, can use pleasantly the detergent bar of the invention.
2. The detergent bar of the invention exhibits good foaming power and detergency during use even in hard water.
3. It causes no skin irritation during use and imparts a soft and smooth feeling to the skin.
4. It can be produced not only by a framing method but also by a milling method. Therefore the detergent bar of the invention can be manufactured with high productivity.

The following examples are further illustrative of this invention. All parts referred to are by weight. The transparency, foaming power and pH value illustrated in the examples are measured by the following procedures.

(1) Test for transparency

The test was carried out by placing the transparent detergent bar of 20 mm thick on the printed letter and reading it through said bar.

If the letter of less than 26 point size can be read clearly, the transparency of the bar was illustrated as mark O. If the letter of more than 26 point size can be read, it was illustrated as mark Δ. If the letter of more than 26 point size cannot be read at all, it was illustrated as mark X.

(2) Test for foaming power

The test was carried out by twenty adults (ten men and ten women). They washed their hands with the detergent bar in the water of about 40° C.

The foaming power of the detergent bar was compared with that of the transparent soap in the market.

If the bar of the invention has the same foaming power as that of the control, the foaming power was estimated as zero.

If the bar of the invention was superior in the foaming power to that of the control, the foaming power was estimated as +1.

If the bar of the invention is inferior in the foaming power to that of the control, the foaming power was estimated as −1.

The total estimated value by twenty adults was illustrated as follows;

−20∼−11:X

−10~0:Δ
1~10:O (3) The measurement of pH value

The pH value of the aqueous solution containing 1% by weight of detergent bar was measured by a pH meter with glass electrode at 40° C.

(4) Test for loss of transparency

After usual washing hands with the transparent detergent bar, its surface was wetted with water without leaving bubbles on the surface. The bar was left standing for 24 hours under the circumstance having the temperature of 24° C. and the relative humidity of 80%. Thereafter the transparency of the surface of the bar was measured by the method of the test for the transparency (1) and the loss of transparency was estimated.

Example 1-6 and control example 1-4.

50 parts of various kinds of N-long chain acyl acidic amino acid-basic amino acid salt shown in Table 1 were added to the mixed solvent of 20 parts of ethanol and 30 parts of water. The resultant mixture was heated at the temperature of 80°-85° C. to dissolve into a clear solution and the solution was poured into a frame, cooled and solidified. The resultant bar was taken out from the frame and dried in a room for 30 days. Then the bar was shaped into the desired shape by a treadle-stamping machine. The transparency, foaming power and pH value of the bar were measured and were given in the following Table 1.

TABLE 1

| | N-long chain acyl acidic amino acid-basic amino acid salt (neutralization degree, equivalent) | trans-parency | foaming power | pH value |
|---|---|---|---|---|
| Example 1 | N-coconut fatty acid acyl-L-glutamic acid L-lysine salt(1.0) | Δ | O | 5.0 |
| Example 2 | N-lauroyl-D-glutamic acid D-lysine salt(1.5) | O | O | 5.4 |
| Example 3 | N-myristoyl-L-glutamic acid L-arginine salt(1.5) | O | O | 6.5 |
| Example 4 | N-mixed fatty acid acyl-L-glutamic acid L-ornithine salt (2.0) | O | Δ | 7.6 |
| Example 5 | N-lauroyl-L-aspartic acid L-lysine salt(1.8) | O | O | 5.2 |
| Example 6 | N-lauroyl-L-glutamic acid DL-lysine salt(1.5) | Δ | O | 5.4 |
| Control 1 | N-coconut fatty acid acyl-DL-glutamic acid L-lysine salt(1.0) | X | O | 5.0 |
| Control 2 | N-myristoyl-L-glutamic acid L-argine salt(0.8) | X | Δ | 5.8 |
| Control 3 | N-mixed fatty acid acyl-L-glutamic acid L-ornithine salt (2.2) | O | X | 8.3 |
| Control 4 | N-lauroyl-DL-aspartic acid DL-lysine salt(1.8) | X | O | 5.2 |

The mixed fatty acid in example 4 and control 3 in Table 1 means a mixture of 15% of coconut oil fatty acid and 85% of semi hardened beef tallow fatty acid. From the result shown in Table 1, it will be understood that transparent detergent bar having excellent transparency and foaming power is obtained when the acidic amino acid of N-long chain acyl acidic amino acid derivatives is optically active and the neutralization degree is 1.0-2.0 equivalent.

Example 7-13. and control example 5-9

20 parts of water was added to 80 parts of N-long chain acyl acidic amino acid-basic amino acid salt shown in Table 2. The resultant mixture was milled enough on a small rolling mill and extruded into a bar from a small plodder of which nozzle temperature was kept at 40° C. The detergent bar was shaped by a treadle-stamping machine. The transparency, foaming power and pH value of the bar were measured and were given in the following Table 2.

TABLE 2

| | N-long chain acyl acidic amino acid-basic amino acid salt (neutralization degree, equivalent) | trans-parency | foaming power | pH value |
|---|---|---|---|---|
| Example 7 | N-coconut fatty acid acyl-L-glutamic acid L-lysine salt(1.0) | Δ | O | 5.0 |
| Example 8 | N-lauroyl-L-glutamic acid L-lysine salt(1.5) | O | O | 5.4 |
| Example 9 | N-myristoyl-L-glutamic acid L-arginine salt(1.5) | O | O | 6.5 |
| Example 10 | N-mixed fatty acid acyl-L-glutamic acid L-ornitine salt (2.0) | O | Δ | 7.6 |
| Example 11 | N-lauroyl-L-aspartic acid L-lysine salt(1.8) | O | O | 5.2 |
| Example 12 | N-stearoyl-L-glutamic acid L-lysine salt(1.9) | Δ | Δ | 7.5 |
| Example 13 | N-lauroyl-L-glutamic acid D L-lysine salt(1.5) | Δ | O | 5.4 |

TABLE 2-continued

| | N-long chain acyl acidic amino acid-basic amino acid salt (neutralization degree, equivalent) | trans-parency | foaming power | pH value |
|---|---|---|---|---|
| Control 5 | N-coconut fatty acid acyl-DL-glutamic acid L-lysine salt(1.0) | X | O | 5.0 |
| Control 6 | N-myristoyl-L-glutamic acid L-arginine salt(0.8) | X | Δ | 5.8 |
| Control 7 | N-mixed fatty acid acyl-L-glutamic acid L-ornithine salt(2.2) | O | X | 8.3 |
| Control 8 | N-lauroyl-DL-aspartic acid DL-lysine salt(1.8) | X | O | 5.2 |
| Control 9 | N-stearoyl-DL-glutamic acid L-lysine salt(2.3) | X | X | 8.8 |

The mixed fatty acid in Example 10 and control 7 in Table 2 means a mixture of 15% of coconut oil fatty acid and 85% of semi hardened beef tallow fatty acid.

From the result shown in Table 2, the transparent detergent bar having excellent transparency and foaming power is obtained when the acidic amino acid of N-long chain acyl acidic amino acid derivatives is not racemic but optionally active form and the neutralization degree is 1.0–2.0 equivalent.

The transparent detergent bars were prepared by a framing method in the following examples 14–18 and the same were prepared by a milling method in the following examples 19–22 according to the particulars described in the preceding examples.

Example 14.

| | Parts |
|---|---|
| N-coconut fatty acid acyl-L-glutamic acid L-lysine salt (1.7 equivalent) | 49 |
| Sucrose | 22 |
| Water | 16 |
| Ethanol | 13 |
| Coloring matter | q.s. |

Example 15

| | Parts |
|---|---|
| N-lauroyl-L-glutamic acid L-lysine salt (2.0 equivalent) | 40 |
| N-stearoyl-L-glutamic acid L-lysine salt (2.0 equivalent) | 10 |
| Maltitol | 10 |
| Water | 24 |
| Ethanol | 16 |
| Perfume | q.s. |

Example 16

| | Parts |
|---|---|
| N-myristoyl-L-glutamic acid L-arginine salt (1.5 equivalent) | 45 |
| Ethyleneglycol | 18 |
| Lauric acid diethanol amide | 5 |
| Water | 17 |
| Ethanol | 15 |

Example 17

| | Parts |
|---|---|
| N-palmitoyl-L-glutamic acid L-ornithine salt (1.2 equivalent) | 40 |
| Diglycerine | 20 |
| Coconut fatty acid sodium salt | 6 |
| Water | 20 |
| Ethanol | 14 |

Example 18

| | Parts |
|---|---|
| N-palmitoyl-L-glutamic acid L-lysine salt (1.9 equivalent) | 40 |
| N-lauroyl-L-glutamic acid monosodium salt | 3 |
| Glycerine | 18 |
| Water | 23 |
| Ethanol | 16 |

Example 19

| | Parts |
|---|---|
| N-coconut fatty acid acyl-L-glutamic acid L-lysine salt(1.8 equivalent) | 60 |
| N-mixed fatty acid acyl-L-glutamic acid L-lysine salt(2.0 equivalent) | 27 |
| Glycerine | 3 |
| Water | 10 |
| Perfume | q.s. |

Mixed fatty acid means a mixture of 15% of coconut fatty acid and 85% of semi hardened beef tallow fatty acid.

Example 20

| | Parts |
|---|---|
| N-myristoyl-L-glutamic acid L-arginine salt (1.8 equivalent) | 40 |
| N-lauroyl-L-aspartic acid L-ornithine salt (2.0 equivalent) | 18 |
| Sucrose | 5 |
| Propyleneglycol | 2 |
| Water | 35 |
| Coloring matter | q.s. |

Example 21

| | Parts |
|---|---|
| N-palmitoyl-L-glutamic acid L-lysine salt (1.4 equivalent) | 50 |
| N-lauroyl-L-cysteic acid L-arginine salt (1.0 equivalent) | 6 |
| N-oleoyl-L-glutamic acid-L lysine salt (1.2 equivalent) | 32 |
| Lauric acid diethanol amide | 5 |
| Lauroyl sarcosine sodium salt | 2 |
| Water | 5 |
| Perfume | q.s. |

Example 22

| | Parts |
|---|---|
| N-stearoyl-L-glutamic acid L-lysine salt (1.5 equivalent) | 50 |
| N-coconut fatty acid acyl-L-glutamic acid L-ornithine salt(1.3 equivalent) | 24 |
| Sodium laurate | 3 |
| Diglycerine | 3 |
| Surcrose | 5 |
| Water | 15 |

The result of test for transparency and foaming power of each transparent detergent bar in Examples 14–22 was shown in Table 3.

TABLE 3

| | 14 | 15 | 16 | 17 | 18 | 19 | 20 | 21 | 22 |
|---|---|---|---|---|---|---|---|---|---|
| transparency | O | O | O | Δ | O | O | O | Δ | O |
| foaming power | O | Δ | O | O | Δ | O | Δ | O | O |

All of the transparent detergent bars illustrated in examples 1–22 had good foaming power not only in soft water but also in hard water and good detergency. They were moderately soluble in water but did not readily disintegrate, gave a soft feeling to the skin after use and did not cause irritation of the skin.

Example 23

20 parts of water were added to 80 parts of the mixture of N-coconut fatty acid acyl-L-glutamic acid L-lysine salt of various neutralization degree and urea shown in Table 4. The resultant mixture was milled enough on a small rolling mill and then extruded into a bar from a small plodder of which nozzle temperature was kept at 40° C. The detergent bar was shaped by a stamping machine. The transparency, foaming power, pH value and reduction of transparency of the bar were measured. The result was shown in Table 4.

TABLE 4

| Sample No. | Neutralization degree, equivalent | N-coconut fatty acid acyl-L-glutamic acid L-lysine salt/urea 100/0 | 95/5 | 85/15 | 70/30 | 50/50 | pH value |
|---|---|---|---|---|---|---|---|
| 1 | 1.0 | Δ/X-Δ | Δ/Δ | Δ/Δ | O/O | O/O | 5.0 |
| 2 | 1.4 | Δ/X-Δ | Δ/Δ | O/O | O/O | O/O | 5.4 |
| 3 | 1.8 | O/Δ | O/O | O/O | O/O | O/O | 6.3 |
| 4 | 2.0 | O/O-Δ | O/O | O/O | O/O | O/O | 7.0 |

The marks in the left upper corner and in the right lower corner in twenty sections in Table 4 indicate respectively transparency of the bar and the transparency after the test for loss of transparency.

As shown in Table 4, incorporation of urea into N-long chain acyl-L-glutamic acid L-lysine salt prevented the loss or reduction of transparency.

Example 24 and 25, control example 10 and 11

Transparency and pH value were measured in the detergent bar manufactured as in Example 23 with various kinds of N-long chain acyl-optically active acidic amino acid-basic amino acid salt and urea shown in Table 5.

TABLE 5

| | N-long chain acyl acidic amino acid-basic amino acid salt (neutralization degree, equivalent) | the mixing ratio of N-long chain acyl acidic amino acid-basic amino acid salt to urea | transparency | pH value |
|---|---|---|---|---|
| Example 24 | N-stearoyl-L-glutamic acid L-lysine salt(1.9) | 80/20 | O | 7.5 |
| Example 25 | N-lauroyl-L-glutamic acid DL-lysine salt(1.5) | 80/20 | O | 5.4 |
| Control 10 (Example 12) | N-stearoyl-L-glutamic acid L-lysine salt(1.9) | 100/0 | Δ | 7.5 |
| Control 11 (Example 13) | N-lauroyl-L-glutamic acid DL-lysine salt(1.5) | 100/0 | Δ | 5.4 |

Example 26

50 parts of the mixture of N-mixed fatty acid (the mixture of 15% coconut fatty acid and 85% of semi hardened beef tallow fatty acid)-acyl-L-glutamic acid L-lysine salt having various neutralization degree shown in Table 6 and urea were added to the mixed solvent of 20 parts of ethanol and 30 parts of water.

The resultant mixture was heated at 80°–85° C. to dissolve into a clear solution, then the solution was poured into a frame, cooled and solidified. The bar was taken out from the frame, dried in a room for 30 days and then shaped by a stamping machine. The transparency, the degree of the reduction of transparency and pH value were measured. The result was shown in Table 6. The particular was described in Example 23.

TABLE 6

| Sample No. | neutralization degree, equivalent | N-mixed fatty acid acyl-L-glutamic acid L-lysine salt/urea 100/0 | 95/5 | 80/20 | 70/30 | 50/50 | pH value |
|---|---|---|---|---|---|---|---|
| 5 | 1.3 | Δ-X/ | Δ-X/ | Δ-X/ | Δ/ | O/ | 6.1 |

TABLE 6-continued

| Sample No. | neutralization degree, equivalent | N-mixed fatty acid acyl-L-glutamic acid L-lysine salt/urea 100/0 | 95/5 | 80/20 | 70/30 | 50/50 | pH value |
|---|---|---|---|---|---|---|---|
| | | X | Δ-X | Δ-X | Δ | O | |
| 6 | 1.5 | Δ-X/X | Δ-X/Δ-X | Δ/Δ | O/O | O/O | 6.5 |
| 7 | 1.7 | Δ/X | Δ/Δ | O/O | O/O | O/O | 6.9 |
| 8 | 2.0 | Δ-O/X | O/O | O/O | O/O | O/O | 7.6 |

Example 27 and 28, Control example 12 and 13

The detergent bar was prepared according to the method described in example 26 with various kinds of N-long chain acyloptically active acidic amino acid-basic amino acid salt and urea shown in Table 7. The transparency and the pH value of the bar were measured. The result was shown in Table 7.

TABLE 7

| | N-long chain acyl acidic amino acid-basic amino acid salt (neutralization degree, equivalent) | the mixing ratio of N-long chain acyl acidic amino acid-basic amino acid salt to urea | transparency | pH value |
|---|---|---|---|---|
| Example 27 | N-coconut fatty acid acyl-L-glutamic acid L-lysine salt(1.0) | 80/20 | O | 5.0 |
| Example 28 | N-lauroyl-L-glutamic acid-DL-lysine salt(1.5) | 80/20 | O | 5.4 |
| Control Example 12 | N-coconut fatty acid acyl-L-glutamic acid L-lysine salt(1.0) | 100/0 | Δ | 5.0 |
| Control Example 13 | N-lauroyl-L-glutamic acid DL-lysine salt(1.5) | 100/0 | Δ | 5.4 |

As shown in Tables 5–7, the mixing of urea with N-long chain acyl acidic amino acid-basic amino acid salt prevents the reduction of transparency of the bar caused by the low neutralization degree with basic amino acid in N-long chain acyl acidic amino acid derivatives.

The transparent detergent bars were prepared by a framing method in the following examples 29–33 and the same were prepared by a milling method in the following examples 34–37 according to the particulars described in the proceeding examples.

| | Parts |
|---|---|
| N-coconut fatty acid acyl-L-glutamic acid L-lysine salt (1.6 equivalent) | 52 |
| Urea | 4 |
| Glycerin | 1 |
| Water | 27 |
| Ethanol | 16 |
| Colouring matter and perfume | q.s. |

Example 30

| | Parts |
|---|---|
| N-mixed fatty acid acyl-L-glutamic acid L-arginine salt (1.5 equivalent) | 50 |

-continued

| | Parts |
|---|---|
| Urea | 12 |
| Lauric diethanol amide | 3 |
| Water | 23 |
| Ethanol | 12 |
| Perfume | q.s. |

Example 31

| | Parts |
|---|---|
| N-myristoyl-L-glutamic acid L-arginine salt (1.8 equivalent) | 40 |
| N-stearoyl-L-glutamic acid L-lysine salt (1.8 equivalent) | 10 |
| Urea | 7 |
| 2-coconut fatty acid alkyl-N-carboxy methyl-N-hydroxy ethyl imidazolynium betaine sodium salt | 2 |
| Water | 27 |
| Ethanol | 14 |

Example 32

| | Parts |
|---|---|
| N-palmitoyl-L-glutamic acid L-ornithine salt (1.1 equivalent) | 38 |
| Urea | 18 |
| Glycerine | 4 |
| Coconut fatty acid sodium salt | 6 |
| Water | 20 |
| Ethanol | 14 |
| Perfume | q.s. |

Example 33

| | Parts |
|---|---|
| N-coconut fatty acid acyl-L-glutamic acid L-lysine salt(1.6 equivalent) | 30 |
| N-mixed fatty acid acyl-L-glutamic acid L-lysine salt (1.6 equivalent) | 22 |
| Urea | 9 |
| N-lauroyl sarcosine sodium salt | 3 |
| Glycerine | 2 |
| Water | 22 |
| Ethanol | 12 |

Example 34

| | Parts |
|---|---|
| N-myristoyl-L-glutamic acid L-arginine salt (1.7 equivalent) | 40 |
| N-lauroyl-L-aspartic acid L-ornithine salt (1.9 equivalent) | 18 |
| Urea | 5 |
| Sucrose | 2 |
| Water | 35 |
| Coloring matter | q.s. |

Example 35

| | Parts |
|---|---|
| N-palmitoyl-L-glutamic acid L-lysine salt (1.4 equivalent) | 50 |
| N-lauroyl-L-cysteic acid L-arginine salt (1.0 equivalent) | 5 |

-continued

| | Parts |
|---|---|
| N-oleoyl-L-glutamic acid L-lysine salt | 30 |
| Urea | 5 |
| Thiourea | 1 |
| Water | 9 |
| Perfume | q.s. |

Example 36

| | Parts |
|---|---|
| N-stearoyl-L-glutamic acid L-lysine salt (1.5 equivalent) | 50 |
| N-coconut fatty acid acyl-L-glutamic acid L-ornithine salt(1.3 equivalent) | 24 |
| N-lauroyl-N-methyl-β-alanine sodium salt | 3 |
| Urea | 8 |
| Water | 15 |

Example 37

| | Parts |
|---|---|
| N-coconut oil fatty acid acyl-L-glutamic acid L-lysine salt(1.6 equivalent) | 48 |
| N-mixed fatty acid acyl-l-glutamic acid L-lysine salt | 22 |
| Urea | 17 |
| Glycerine | 3 |
| Water | 10 |
| Perfume | q.s. |

All of the transparent detergent bars illustrated in example 29-37 had good transparency and were estimated as the mark O. They had good foaming power not only in soft water but also in hard water and good detergency. They were moderately soluble in water but did not readily disintegrate, gave a soft feeling to the skin after use and did not cause irritation of the skin.

The transparent detergent bars of the invention did not generate bad odor even though they were left standing at 40° C. for 2 weeks.

What we claim is:

1. A transparent detergent bar possessing good foaming power and detergency in hard water consisting essentially of at least one basic amino acid salt of N-long chain acyl-optically active acidic amino acid prepared by the neutralization reaction of 1 mol of N-long chain acyl-optically active acidic amino acid with 1 to 2 mols to basic amino acid and water, the amount of water being in the range of 5 to 25% by weight of the detergent bar apart from water when the neutralization degree of the basic amino acid salt is 1.0 to 1.5 equivalent and 5 to 35% by weight of the detergent bar apart from water when the neutralization degree is 1.6 to 2.0 equivalent.

2. A transparent detergent bar as set forth in claim 1, wherein said long chain acyl group is the acyl radical of a saturated or unsaturated fatty acid having 10 to 20 carbon atoms.

3. A transparent detergent bar as set forth in claim 1, wherein said optically active acidic amino acid is at least one member selected from the group consisting of L or D form of aspartic acid, glutamic acid, cysteic acid and homocysteic acid.

4. A transparent detergent bar as set forth in claim 1, wherein said basic amino acid is at least one member selected from the group consisting of L or D form of lysine, arginine and ornithine.

5. A transparent detergent bar as set forth in claim 1, further containing urea, wherein the ratio by weight of the amount of basic amino acid salt of N-long chain acyl-optically active acidic amino acid to the amount of urea is from 95:5 to 50:50.

6. The detergent bar of claim 1, containing as adjuvants at least one of a polyhydric alcohol and a saccharide, an additional surface active agent and, optionally, a perfume and coloring matter, the adjuvants being present in amount that they do not inhibit the transparency of the bar.

7. A method of making a transparent solid detergent bar possessing good foaming power and detergency in hard water which comprises dissolving at least one basic amino acid salt of N-long chain acyloptically active acidic amino acid of neutralization degree of 1 to 2 equivalent in a mixture of lower alcohol and water, pouring the resultant solution into a frame, cooling, solidifying, cutting and drying into a shaped solid bar, the amount of water being in the range of 5-25% by weight of the detergent bar apart from water when the neutralization degree of the said basic amino acid salt is 1.0 to 1.5 and 5 to 35% by weight of the detergent bar apart from water when the neutralization degree is 1.6 to 2.0 equivalent.

8. A method as set forth in claim 7, wherein urea is added to said basic amino acid salt of N-long chain acyl-optically active acidic amino acid, the ratio by weight of the amount of said basic amino acid salt to the amount of urea added being from 95:5 to 50:50.

9. A method of making a transparent solid detergent bar possessing good foaming power and detergency in hard water which comprises milling a mixture of water and at least one basic amino acid salt of N-long chain acyl-optically active acidic amino acid of neutralization degree of 1 to 2 equivalent extruding a milled mixture from a plodder and stamping into a shaped solid bar, the amount of water being in the range of 5 to 25% by weight of the detergent bar apart from water when the neutralization degree of the said basic amino acid salt is 1.0 to 1.5 and 5 to 35% by weight of the detergent bar apart from water when the neutralization degree is 1.6 to 2.0 equivalent.

10. A method as set forth in claim 9, wherein urea is incorporated into said mixture to provide a ratioby weight of the amount of said basic amino acid salt to amount of urea of from 95:5 to 50:50.

* * * * *

UNITED STATES PATENT AND TRADEMARK OFFICE

CERTIFICATE OF CORRECTION

PATENT NO. : 4,273,684

DATED : Jun. 16, 1981

INVENTOR(S) : TETSUYA NAGASHIMA ET AL

It is certified that error appears in the above—identified patent and that said Letters Patent is hereby corrected as shown below:

Please correct the Priority Data to read as follows:

[30]--Foreign Application Priority Data

May 31, 1979 [JP] Japan.....54-66788

Feb. 13, 1980 [JP] Japan.....55-15555-- rather than

[30]--Foreign Application Priority Data

May 3, 1979 [JP] Japan.....54-66788

Feb. 13, 1980 [JP] Japan.....55-15555 -- as it now appears.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*